US005638852A

United States Patent [19]

Dean

[11] Patent Number: 5,638,852

[45] Date of Patent: Jun. 17, 1997

[54] COMBINED SUNBATHER SHADE AND CARRYING CASE

[76] Inventor: Hilary Dean, 12401 Orange Grove Dr. #1612, Tampa, Fla. 33618

[21] Appl. No.: 722,853

[22] Filed: Sep. 26, 1996

[51] Int. Cl.[6] ..... E04H 15/44

[52] U.S. Cl. ..... 135/136; 135/137; 135/156

[58] Field of Search ..... 135/124, 125, 135/126, 128, 143, 96, 136, 137, 138, 141, 156, 114, 115, 116, 900

[56] References Cited

U.S. PATENT DOCUMENTS

| | | | |
|---|---|---|---|
| D. 374,512 | 10/1996 | Kiley et al. | 135/124 X |
| 2,190,566 | 2/1940 | Julian . | |
| 2,961,802 | 11/1960 | Mongan et al. | 135/124 X |
| 4,082,102 | 4/1978 | Heuer . | |
| 4,295,481 | 10/1981 | Gee . | |
| 5,546,971 | 8/1996 | Leonhardt | 135/128 X |

FOREIGN PATENT DOCUMENTS

| | | | |
|---|---|---|---|
| 85530 | 7/1895 | Germany | 135/128 |
| 456325 | 12/1950 | Italy | 135/126 |

OTHER PUBLICATIONS

"Pop–Tent Sun Screen", Lifestyle Fascination Catalog, Mid–Summer 1995, p. 42.

*Primary Examiner*—Lanna Mai

*Attorney, Agent, or Firm*—American Innovations, Inc.; Dorothy S. Morse

[57] ABSTRACT

A combined sunbather shade and carrying case including two semicircular-shaped, stretchable panels of opaque material attached together along the arcuate portion of their perimeters, a semi-rigid semicircular tube of sufficient dimension for insertion between the two panels along their arcuate perimeters and for support thereof, easily releasable fastening means to retain the semicircular tube between the panels during use, and an elongated wire component smaller in diameter than the semicircular tube so that each of its ends can be inserted into one of the openings in each end of the semicircular tube, the wire component being made of a flexible material which can be reversibly shaped into different configurations but which is able to retain the configuration into which it is formed until reshaped, the wire component providing a support structure for the semicircular tube and panels, the attached stretchable panels having sufficient dimension for use in preventing solar radiation from reaching selected parts of the body such as the face and the head, as well as sufficient dimension for storing and carrying the semicircular tube, the wire component, and other objects when not in use as a sun shade. Applications may include, but are not limited to, use as a sunshade for a person lying on a flat surface such as a beach or a pool deck, or use as a sunshade by a person positioned on a lawn chair.

7 Claims, 2 Drawing Sheets

COMBINED SUNBATHER SHADE AND CARRYING CASE

BACKGROUND

1. Field of Invention

This invention relates to sunshades and carrying cases, specifically a combined sunbather shade and carrying case comprising two semicircular-shaped, stretchable panels of opaque material attached together along the arcuate portion of their perimeters, a semi-rigid semicircular tube of sufficient dimension for insertion between the two panels along their arcuate perimeters and for support thereof, means such as hook and pile types of fasteners to retain the semicircular tube between the panels during use, and an elongated wire component smaller in diameter than the semicircular tube so that each of its ends can be inserted into one of the openings in each end of the semicircular tube, the wire component being made of a flexible material which can be reversibly shaped into different configurations but which is able to retain the configuration into which it is formed until reshaped, the wire component providing a support structure for the semicircular tube and panels, the attached stretchable panels having sufficient dimension for use in preventing solar radiation from reaching selected parts of the body such as the face and the head, as well as sufficient dimension for storing and carrying the semicircular tube, the wire component, and other objects when not in use as a sun shade. Applications may include, but are not limited to, use as a sunshade for a person lying on a flat surface such as a beach or a pool deck, or use as a sunshade by a person positioned on a lawn chair.

2. Description of Prior Art

A variety of sun shields are known, including inventions which disclose a combination sun shade and carrying case. The invention in U.S. Pat. No. 2,543,597 to Perry (1947) discloses a beach bag comprising canopy material supported around its perimeter by poles having a straight configuration to form a bottom surface and side walls for the beach bag. An extension of canopy material is positioned along one of its side walls for folding across the top opening of the beach bag to dose it. When used as a sun shade, additional poles attach the canopy material on either side of the extension to support the canopy material in an overhead position. The Perry invention has an essentially rectangular configuration with the cross-sectional dimension of its upper opening being somewhat larger than the cross-sectional dimension of its bottom surface. The invention in U.S. Pat. No. 2,853,086 to Biagosch (1955) discloses a sunshade awning similar to the Perry invention which comprises zippers for use in converting it into an substantially rectangular carrying case. The Biagosch invention has handles attached to the outside surfaces of each of its two larger sides. The material forming each larger side of the Biagosch invention extends upwardly and overlaps with material from the other larger side to provide a top closure which can be secured by clips or other closing means. The interior cavity of the Biagosch invention is somewhat wider at its base and is of sufficient size for use in carrying its support poles as well as other objects. The inventions in U.S. Pat. No. 2,819,776 to Balsam (1958) and U.S. Pat. No. 4,180,112 to Bovet (1979) also disclose rectangularly shaped, zippered carrying cases which double in function as sunshades, however each is thinner in profile than the Perry and Biagosch inventions. Although the Perry, Biagosch, Balsam, and Bovet inventions each disclose a combination carrying case and sunshade, none have a configuration similar to that of the present invention. Also, since the present invention does not use a zipper, the present invention is more easily and quickly converted from a sunshade into a carrying case than the Biagosch, Balsam, and Bovet inventions.

The prior art most thought to be most closely related to the present invention in configuration and use as a sunshade are the inventions disclosed in U.S. Pat. No. 4,082,102 to Heuer (1978), U.S. Pat. No. 4,295,481 to Gee (1981), and U.S. Pat. No. 2,190,566 to Julian (1940). The Heuer invention discloses a foldable shielding device having two oval shields attached to opposite ends of connecting rod. Each shield is dimensioned to protect a small body part, such as a person's head or face. It is also contemplated for the Heuer invention to be used as a shielding device for sun sensitive objects, such as small animals, and cameras. The weight of the object, or person, placed upon the bottom shield secures the bottom shield as a base support for the opposed upper shield which can then be positioned so as to protect a desired part of the body or other sun sensitive object. The Gee invention discloses a sun shade having spikes which is readily convertible from a chairback-supported sunshade into a ground-supported sunshade. It has a U-shaped configuration with spikes pivotally attached to the ends of the base portion of the U-shaped structure. When not needed for use, the spikes can be folded into an out-of-the-way position. The Julian invention comprises an elongated rectangular canopy having first ends of two telescoping poles each attached to comers of the canopy adjacent to one of its shorter sides. Through various positions of pole orientation, pole extension, and placement of the second ends of each pole relative to the opposed shorter side of the canopy, a variety of canopy configurations can be created. For example, the poles can be placed vertically into the ground and the opposed shorter side placed remotely from the second ends of the poles to form an L-shaped sun shade. Also, the poles can be placed vertically with the second ends of each pole positioned adjacent to one of the opposed comers of the canopy to form an C-shaped sun shade. Further, the poles can be placed at various acute or obtuse angles with the opposed shorter side of the canopy material placed adjacent to the second ends of the poles, or the second ends of the poles can be placed adjacent to an intermediate portion of the canopy material between its two shorter ends to form a variety of J-shaped sun shades. Although each of these inventions can comprise a C-shaped configuration roughly resembling that of the present invention, the Heuer, Gee, and Julian inventions are not made from two semicircular stretchable panels attached along their arcuate edges, as is the present invention, nor are the Heuer, Gee, and Julian inventions supported in part by a flexible wire component which retains the configuration into which it is bent until reshaped. Also, the Heuer, Gee, and Julian inventions are not contemplated for conversion into a carrying case for transporting objects.

SUMMARY OF INVENTION—OBJECTS AND ADVANTAGES

It is the primary object of this invention to provide a sun shield for selected parts of the body, such as a face or a head. It is also an object of this invention to provide a sun shield which is sufficiently small for placement in carry-on luggage. A further object of this invention is to provide a sun shield which is usable both on flat surfaces such as a beach or a pool deck, and while supported by the back of a lawn chair. It is also an object of this invention to provide a sun shield which is light weight and easy to use. A further object of this invention is to provide a sun shield which can be quickly converted into a carrying case.

As described herein, properly manufactured and used, the present invention would provide combination sun shield and carrying case which is light weight, easy to use, and can be quickly converted into a carrying case for its wire component and other objects. The canopy material would be semi-circular in shape and of sufficient dimension to shield a selected area of the body, such as a face or a head. The canopy would also be made from two stretchable fabric panels and supported during use as a sun shield by a curved length of semi-rigid tubing. The arcuate perimeters of the two panels would be secured together, preferably by stitching, and the straight portions of the panel perimeters would be connected together by easily releasable fasteners. A bendable wire component, the ends of which are each inserted into one of the openings in the ends of the tubing, supports the panels on a flat surface, as well as on the back of a lawn chair. After use as a sun shield, the flexible wire component can be bent so as to fit between the two panels for storage and transport. In addition, other items, such as a towel, may also be carried between the panels. The present invention may also have handles attached to the panels for convenience in using the pouch created by the attached panels as a carrying case.

The description herein provides preferred embodiments of the present invention but should not be construed as limiting the scope of the combination sunbather shade and carrying case invention. For example, variations in the width of the panels, the type and thickness of the stretchable material used to form the panels, the length of the wire component, the diameters of both the wire component and the tubing, the material from which the tubing is made, the type of handles used, and the number and type of fasteners used, other than those shown and described herein, may be incorporated into the present invention. Thus the scope of the present invention should be determined by the appended claims and their legal equivalents, rather than the examples given.

DETAILED DESCRIPTION OF PREFERRED EMBODIMENTS

Figure 1:
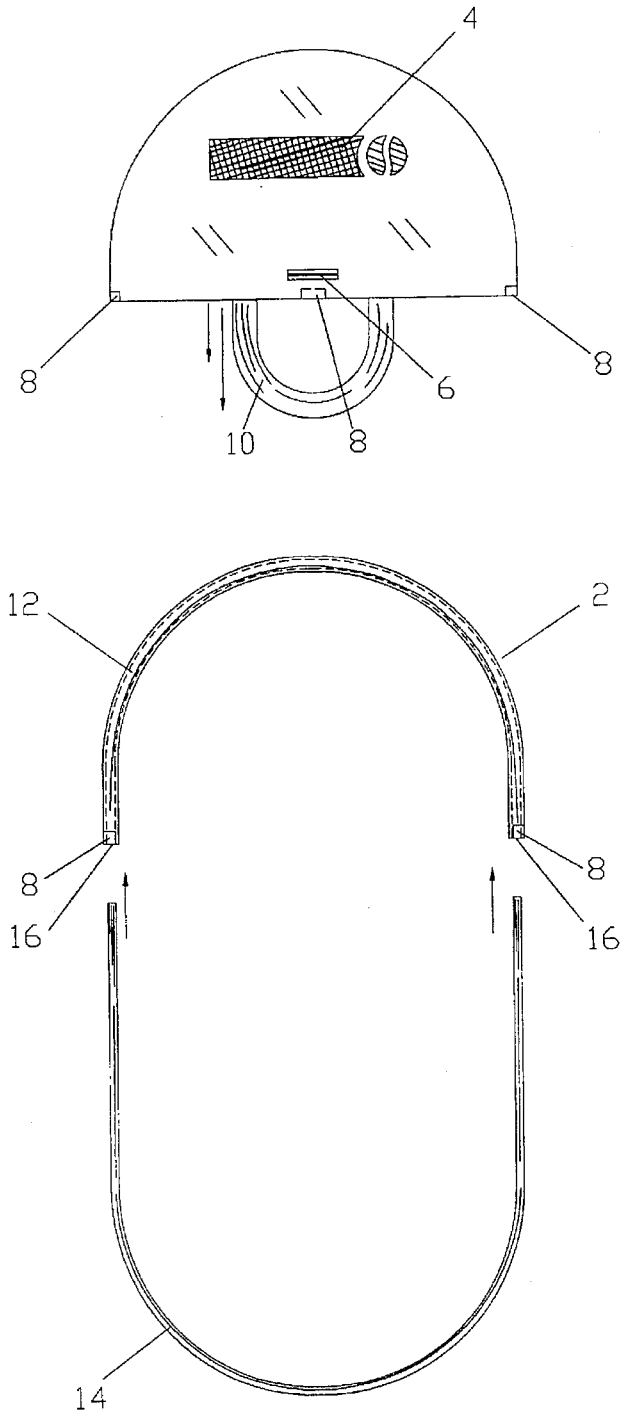
FIG. 1 is a perspective view of the invention in a pre-assembled condition.

FIG. 1 shows a preferred embodiment of a combination sunbather shade and carrying case invention 2 having a flexible wire component 14, a length of semi-rigid arcuate tubing 12, and a fabric panel 4. It is contemplated for wire component 14 to be bendable, but also able to retain the shape into which it is bent until reshaped. It is also contemplated for combined sunbather shade and carrying case invention 2 to comprise two panels 4 which are made of opaque, stretchable fabric, which are semi-circular in shape, and which are joined together on their arcuate perimeters to form a pouch. It is contemplated for panels 4 to be stretchable for a snug fit around tubing 12. Although the dimensions of wire component 14, and the material from which it is made, are not critical to the present invention, in the preferred embodiment wire component 14 has a diameter of approximately three-eighths of an inch, a length of approximately sixty-eight inches, and comprises plastic coated flexible wire. During use as a sun shade, each end of wire component 14 is placed into an opening 16 in one end of tubing 12. Although the dimensions of tubing 12, and the material from which it is made, are not critical to the present invention, in the preferred embodiment tubing 12 has a diameter of approximately one-half of an inch, a length of approximately forty inches, a semi-circular shape, and is made of either plastic or aluminum so as to be light in weight. FIG. 1 also shows one part of a two-part fastener 8 attached to each end of tubing 12. The other part of each two-part fastener 8 is attached to one end of the straight portion of the perimeter of one panel 4. FIG. 1 further shows a handle 10 centrally attached to one panel 4 adjacent to the straight portion of its perimeter. Additionally, FIG. 1 shows panels 4 having an optional cutout handle 6 centrally located through panel 4 adjacent to the straight portion of its perimeter, and one portion of a separate two-part fastener 8 centrally attached to panel 4 adjacent to the straight portion of its perimeter. Although the material from which handle 10 is made is not critical to the present invention, in the preferred embodiment it is contemplated for handle 10 to be made of nylon web material.

Figure 2:
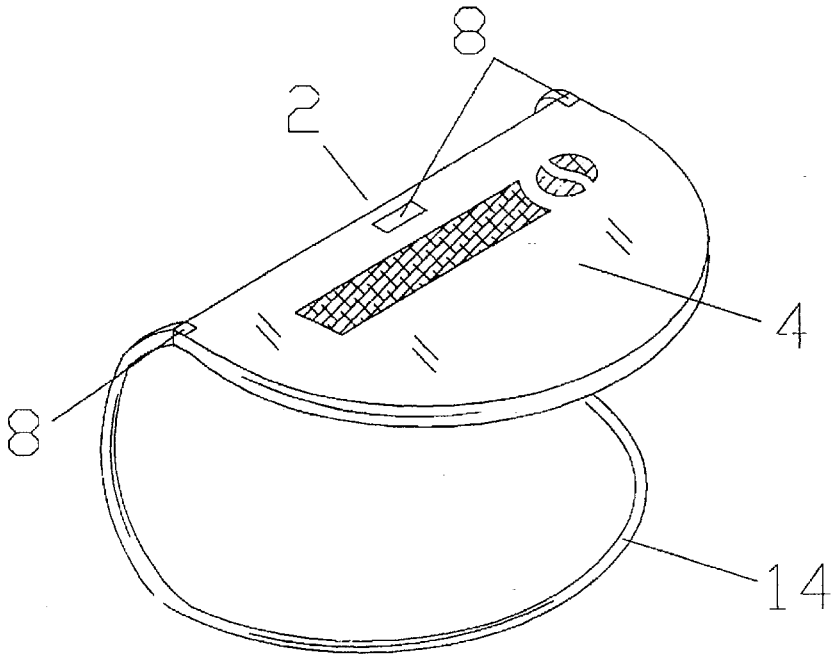
FIG. 2 is a perspective view of the invention having a C-shaped configuration and stretchable panels supported on a flexible wire component which has been bent for use on a flat surface.

FIG. 2 shows wire component 14 bent so that when combined together with panel 4 the present invention has a substantially C-shaped configuration. In FIG. 2 tubing 12 is hidden in the pouch between panels 4 and secured therein by two-part fasteners 8. In the preferred embodiment it is contemplated for the present invention to weigh less than one pound and be dimensioned to fit within carry-on luggage (not shown).

Figure 3:
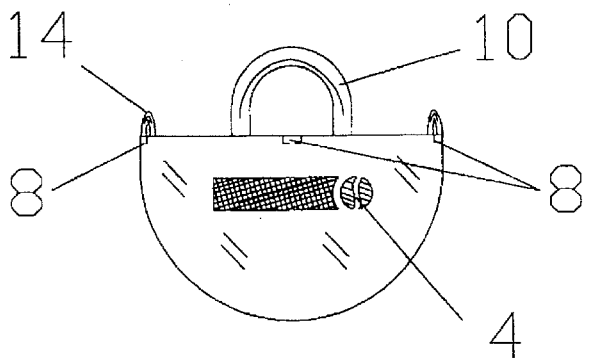
FIG. 3 is a top view of the panel portion of the invention having a U-shaped handle.

FIG. 3 shows panel 4 having handle 10 centrally attached to the straight portion of its perimeter, with two-part fasteners 8 also positioned adjacent to the straight portion of the perimeter. Additionally, FIG. 3 shows wire component 14 connecting into the end of tubing 12 which is positioned within the pouch created by the joining of the arcuate perimeters of panels 4.

To use the present invention, one would remove flexible wire component 14 from within the pouch formed between panels 4 and position tubing 12 between panels 4 so that the joined arcuate perimeters of panels 4 snugly fit against tubing 12. Then depending upon intended use, wire component 14 would be bent in a shape to allow panel 4 to shade a selected body part (not shown) upon a flat surface, or while attached to the back of a lawn chair. When used with a lawn chair, the central portion of wire component 14 is shaped for support between alternate parallel strips of the lawn chair support material extending between the lateral portions of the lawn chair frame.

What is claimed is:

1. A combined sunbather shade and carrying case for use in shielding parts of a human body from solar radiation and use in carrying objects having sufficiently small dimension to fit therein, said combined sunbather shade and carrying case comprising two semicircular-shaped, stretchable panels of opaque material, both of said panels having a perimeter comprising an arcuate portion contiguous with a straight perimeter portion, each of said panels having sufficient size for shielding said parts of a human body from said solar radiation and being attached to the other of said panels along said arcuate portion; a semi-rigid semicircular tube of sufficient dimension for insertion between said panels along said arcuate portions and for support of said arcuate portions during said use to shield said parts of said human body from said solar radiation, said semicircular tube having opposite ends and an opening in each of said opposite ends; easily releasable retaining means to retain said semicircular tube between said panels during both use as a sunshade and as a carrying case; and an elongated wire component having opposite ends, said wire component being smaller in diameter than said openings in said ends of said semicircular tube so that said opposite ends of said wire component can be inserted into said openings, said wire component being made of a flexible material which can be reversibly bent into different configurations but which is able to remain fixed in the configurations into which it is bent until reshaped, said wire component also providing support for said semicircular tube and said panels, said panels having sufficient dimension for use in storing and carrying said semicircular tube, said wire component, and said objects between uses as a sun shade.

2. The combined sunbather shade and carrying case of claim 1 wherein said easily releasable retaining means comprises a plurality of hook and pile type of fasteners.

3. The combined sunbather shade and carrying case of claim 1 wherein said wire component comprises plastic coated wire.

4. The combined sunbather shade and carrying case of claim 3 having two of said handles and wherein said handles comprise nylon web material, and wherein one of said handles is centrally attached to said straight portion of each of said panels.

5. The combined sunbather shade and carrying case of claim 3 wherein said handles comprise a cutout portion through each of said panels of sufficient dimension for insertion therethrough of the fingers of a human hand.

6. The combined sunbather shade and carrying case of claim 3 wherein said wire component is approximately three-eighths of an inch in diameter and approximately sixty-eight inches in length, and said semicircular tube is approximately one-half of an inch in diameter and approximately forty inches in length.

7. The combined sunbather shade and carrying case of claim 1 further comprising at least one handle associated with said panels for carrying said combined sunbather shade and carrying case when used as a carrying device for said objects.

* * * * *